US006891099B1

(12) United States Patent
Davis et al.

(10) Patent No.: US 6,891,099 B1
(45) Date of Patent: May 10, 2005

(54) GUITAR SHAPED GUITAR STAND

(76) Inventors: Larry Steven Davis, 5224 Hendrix Dr., The Colony, TX (US) 75056; Joseph A. Davis, 1001 Carleton Dr., Richardson, TX (US) 75080

( * ) Notice: Subject to any disclaimer, the term of this patent is extended or adjusted under 35 U.S.C. 154(b) by 0 days.

(21) Appl. No.: 10/609,163

(22) Filed: Jun. 30, 2003

(51) Int. Cl.[7] ..... G10D 13/02
(52) U.S. Cl. ..... 84/421
(58) Field of Search ..... 84/421, 453, 327, 84/411 R; 248/404, 405

(56) References Cited

U.S. PATENT DOCUMENTS 5,375,497 A * 12/1994 Pirchio et al. ..... 84/327

6,316,706 B1 * 11/2001 Sammons ..... 84/327

* cited by examiner

*Primary Examiner*—Kimberly Lockett
(74) *Attorney, Agent, or Firm*—William W. Haefliger

(57) ABSTRACT

A guitar stand, comprising in combination a generally upright backer having a front side that is inclined rearwardly, structure supporting the backer, and a guitar body support or supports, carried by the backer or said structure to project outwardly relative to said front face, to seat the lower portion or portions of the guitar body, with the guitar and its fingerboard then inclined upwardly and rearwardly proximate said backer front side. The stands enables backer sizing to substantially fit or match to whatever guitar is to be supported, in cradled position.

18 Claims, 3 Drawing Sheets

10
11j
11f
42
11c
25
11e
28d
15
15a
11g
26
13
11i
28b
11h
11a
11
24
11d
28c
14
14a
2
2

36
11a
28
17
24
28b
α
13
11b
10
30
18
16
14
3
3

11i
11j
11h
10
11b
11
17
18
11e
11d
14
15
15a
16
14a
13

11
30
31
28
24
20
20a
28b
16
16a
31a
51
50

GUITAR SHAPED GUITAR STAND

BACKGROUND OF THE INVENTION

This invention relates generally to supporting and display of musical instruments; more particularly, it concerns a novel guitar stand for displaying a guitar in position for easy removal from the stand, as well as stable support by the stand.

There is need for an improved guitar stand as referred to above, as well as need for the unusual combinations of structure, function and results, as appear herein, including a stand conceptually shaped as a guitar, or portion of a guitar.

SUMMARY OF THE INVENTION

It is a major object to provide an unusually advantageous and practical guitar stand to meet the above described needs. Basically, the preferred stand comprises, in combination:

a) a generally upright backer having a front side that is inclined rearwardly, the backer typically having generally the same size and shape as the guitar body to be supported, b) structure supporting the backer, c) and a guitar body support or supports carried by the backer or said structure to project outwardly relative to said front face, to seat the lower portion or portions of the guitar body, with the guitar and its fingerboard then inclined upwardly and rearwardly proximate said backer front side.

As will appear, the supports are spaced to seat lower left and right portions of the guitar body. This enables three point-cradling of a guitar body, with respect to the supports (such as pegs) and the inclined backer against which the guitar body leans. For example, the guitar body typically projects downwardly at the space between the left and right supports and the backer typically projects upwardly rearwardly of the guitar body and fingerboard.

It is another object of the invention to provide backer support structure that includes leg means projecting downwardly relative to the backer, whereby the guitar is cradled by the backer and said outwardly projecting supports.

As will appear, the leg means may have floor engaging parts or surfaces which are spaced apart to stably support the backer with a guitar body seated on said body support or supports. Further, the leg means may include a rear leg projecting downwardly from a rear portion of the backer. That rear leg may be pivotally connected to the backer, to swing between collapsed position adjacent the backer, and extended position projecting away from the backer rear portion. A holder may be provided and carried by the backer to hold the rear leg in said collapsed position, and it may include magnet structure, for ease of attachment and detachment.

Yet another object is to provide a backer front side having a display surface or face, with a display design on said front face, to be fully visible when a guitar is removed from supported relation by said backer and projecting supports.

An additional object is to provide an improved guitar stand that incorporates a) a guitar carrier and a three point guitar body support on the carrier, b) and a multi-point ground engaging support for the carrier, The backer may have a guitar body curved outline as will be seen.

These and other objects and advantages of the invention, as well as the details of an illustrative embodiment, will be more fully understood from the following specification and drawings, in which:

DRAWING DESCRIPTION

DETAILED DESCRIPTION

Figure 1:
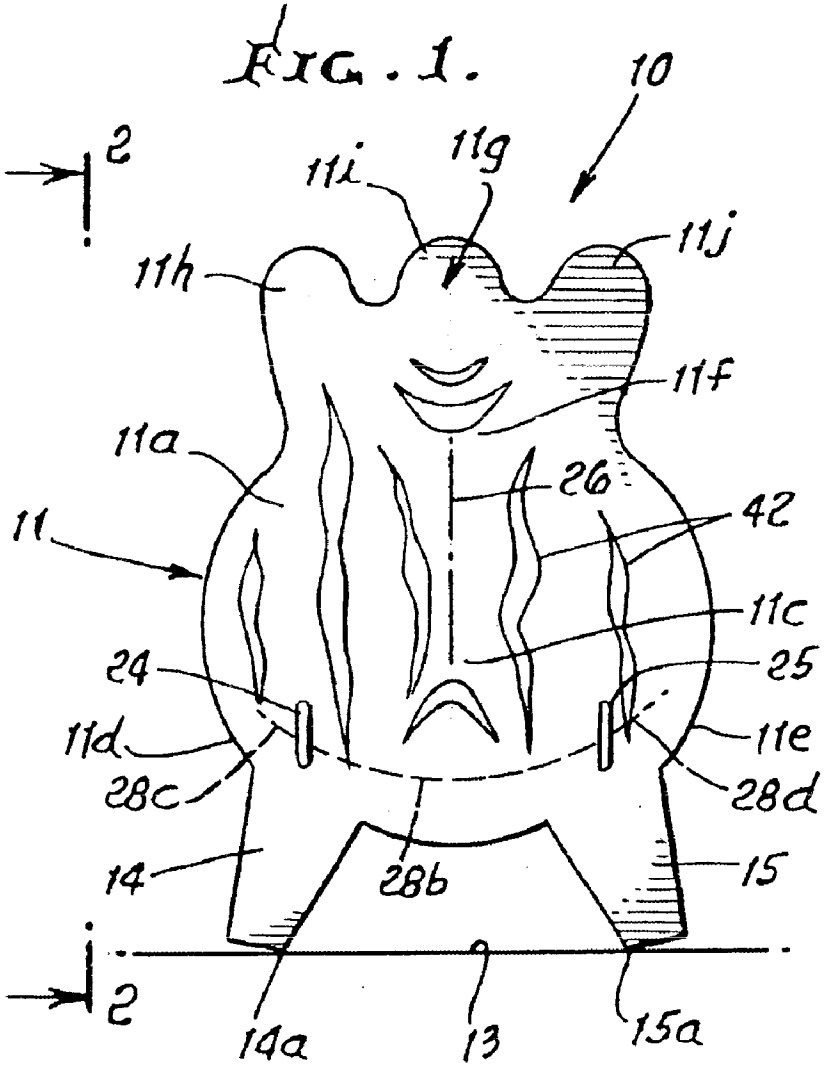
FIG. 1 is a front view of a guitar stand embodying the invention.
Figure 2:
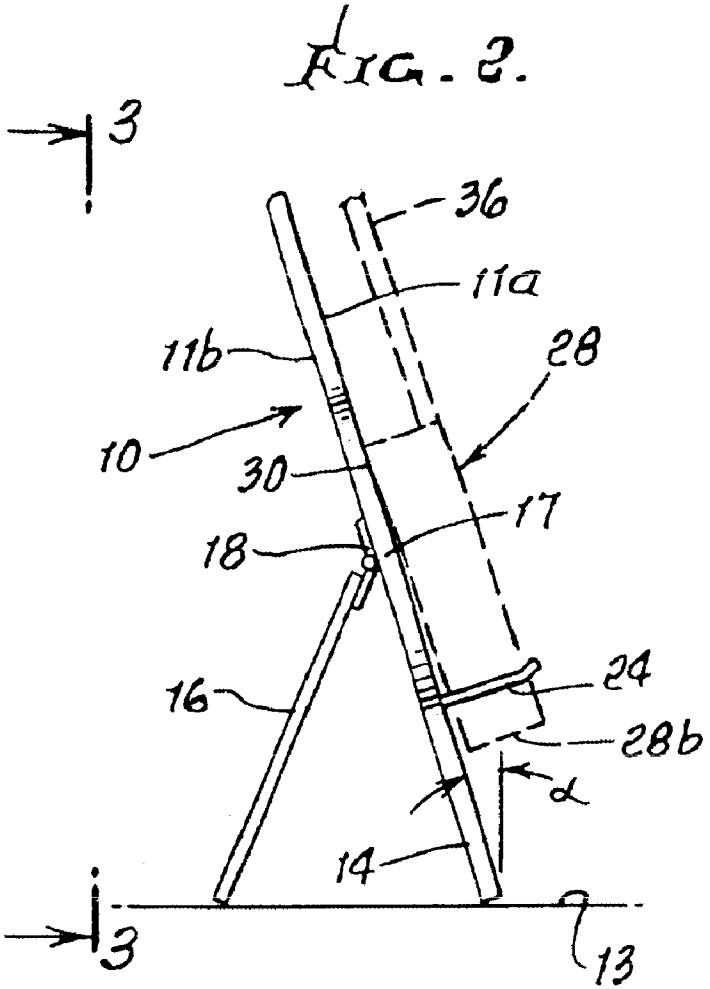
FIG. 2 is a left side elevation taken on lines 2—2 of FIG. 1.
Figure 3:
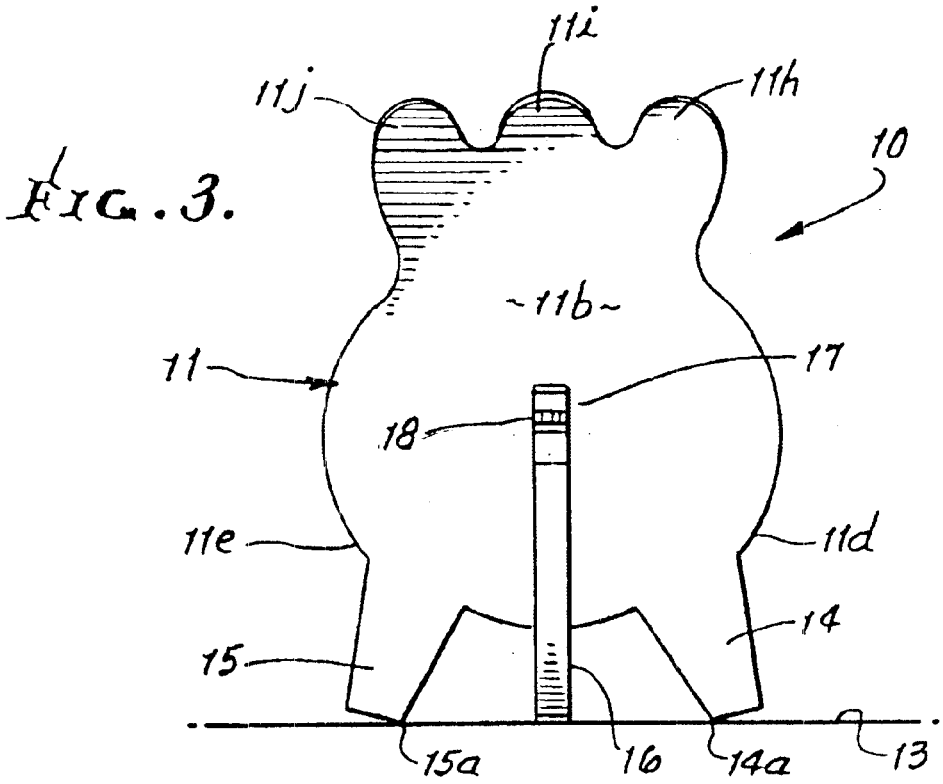
FIG. 3 is a rear elevational view of the guitar stand, taken on lines 3—3 of FIG. 2.

In FIGS. 1–3 a preferred guitar stand 10 includes an upright backer 11 such as a panel having a front side 11*a* and a rear side 11*b*. The backer is inclined rearwardly from vertical at an angle $\alpha$, which is typically between 10° and 30°. The backer typically has a lower portion 11*c* that may be outline shaped generally like a guitar body lower portion, with left and right downwardly and sidewardly convex edges 11*d* and 11*e*, and a narrowed mid-portion 11*f*. The upper portion 11*g* of the backer may have various shapes with one or more upward projections as at 11*h*, 11*i* and 11*j*, corresponding to various guitar shapes. The front face or side of the backer typically has an attractive decorative display design applied to it, which is fully visible when a guitar is removed from the backer. See for example wavy strands 42.

Structure is provided to support the backer in its inclined position, above floor level 13. That structure may include leg means projecting downwardly relative to the backer. See for example left and right legs 14 and 15 with floor engaging parts or surfaces 14*a* and 15*a* which are spaced apart to stably support the backer 11 in guitar cradling position. Legs 14 and 15 may comprise lower extensions of a backer plate.

The leg means may also include a rear leg 16 projecting downwardly from a rear mid-portion 17 of the backer. It is preferably pivotally connected, as by a hinge 18, to the backer to swing between collapsed position (see broken lines 16*a* in FIG. 4), and extended position (see full lines in FIG. 4) projecting downwardly away from the backer rear mid-portion. When fully extended, it supports the backer at its preferred inclined angularity $\alpha$, which may be adjusted. The rear leg may be releasably retained or held to the backer, in collapsed position (as for storage) by a holder such as a magnet) or magnet parts 20 and 20*a*, attached to the leg and backer, as shown.

Also provided is a guitar body support or supports carried by the backer or said structure to project outwardly relative to said front face, to seat the lower portion or portions of the guitar body, with the guitar and its fingerboard then inclined upwardly and rearwardly proximate said backer front side.

Figure 4:
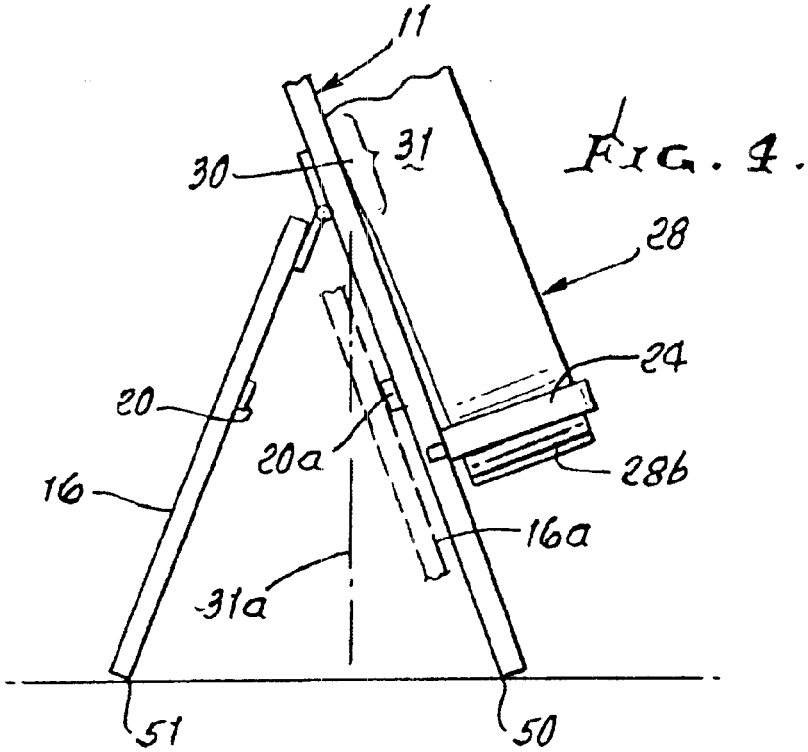
FIG. 4 is an enlarged side view, like FIG. 2, but showing details of construction and guitar support.
Figure 5:
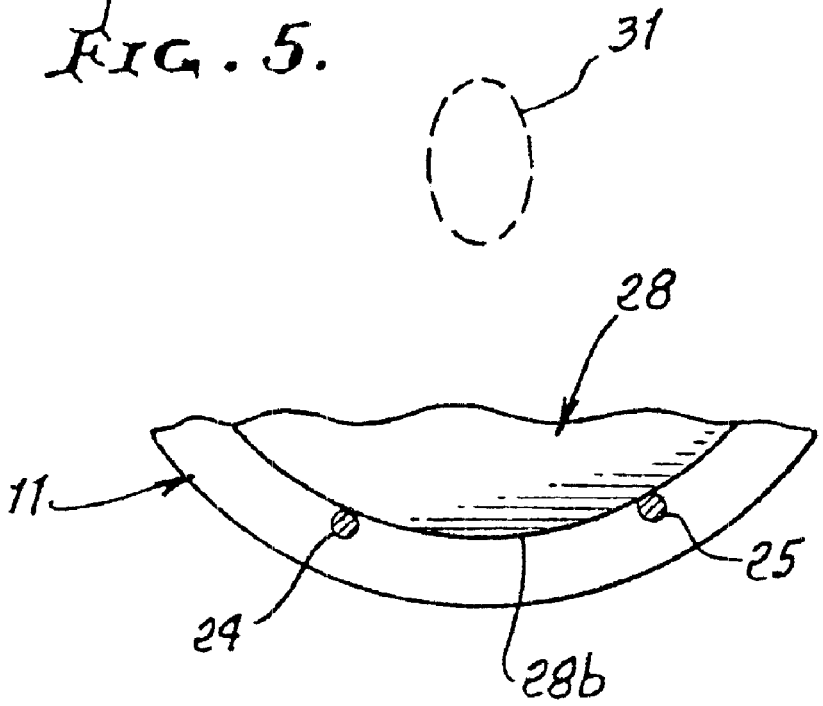
FIG. 5 is a schematic frontal view of supports supporting a guitar body.

The support or supports are typically located to seat lower left and right portion 28*c* and 28*d* of the guitar body 28 so that the guitar body lower rim is stably supported, i.e. preferably cradled. See for example the left and right pegs 24 and 25 removably carried by the backer, at opposite sides of a vertical central plane indicated at 26 in FIG. 1. The pegs may be angled to project forwardly and upwardly as seen in FIG. 4, to extend generally parallel to the sides 28*c* and 28*d* of the guitar body 28, for stable support. The guitar body lowermost central portion 28*b* extends between and below the level of pegs 24 and 25, as seen in FIGS. 1, 4 and 5, and rear part or panel 30 of the guitar body rests against the backer as at a location indicated at 31 in FIGS. 4 and 5.

This provides a three point stable support for the rearwardly leaning guitar lower portion, i.e. a stable, protective, cradled position. Also, the guitar can be simply removed from the stand by picking it upwardly, and subsequently simply replaced downwardly in leaning and cradled position, into on onto the stand.

The guitar fingerboard 36 extends upwardly above the levels of the body support points at the pegs 24 and 25 and at 31, and may extend above the level of the stand and backer; but the stable support is such that the fingerboard and guitar may be deflected somewhat to the right or to the left, i.e. twisted, yet the stable 3-point support of the guitar remains in effect.

That 3-point support is further stabilized or enhanced by the 3-point support of the stand on the floor, as provided by the left and right legs, and rear leg. Note in FIG. 4 that the support point or region 31 of the guitar body back is located such that a downward projection 31*a* from location 31 preferably lies between vertical planes at locations 50 and 51 of forward and rear leg engagement and with the floor, providing added stability.

Accordingly, the invention provides a dual gravitationally interacting, three-point support system, the guitar, being gravitationally stably and safety supported multi-directionally (i.e. cradled) even though the guitar may be somewhat vertically misaligned relative to the stand when placed downwardly in inclined position in the stand.

Figure 6:
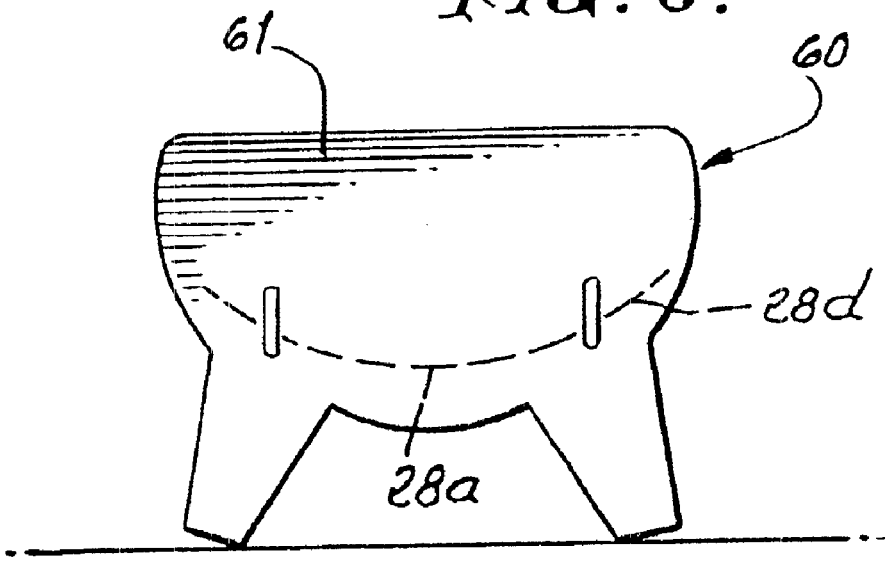
FIG. 6 is a view like FIG. 1, but showing a modification.

FIG. 6 shows a modified stand 60, wherein the backer 61 is confined at a lower level, i.e. does not project upwardly to the level of the guitar fingerboard; yet, it retains the unusually advantageous support features as described above.

In one specific example the stand is a hand made, hand painted, functional work of art. Such high quality stands may be cut to the same size and general shape of the individual guitars to be supported. A single rear leg design is applicable for all guitar styles simply by lengthening or shortening that leg. The pegs that the guitar rest on may be about ⅝ inch in diameter, and consist of oak covered with either nylon or surgical hose. The backer leans back on a 16 inch long 2.5 inch wide rear leg attached to the stand with a two inch wide, metal plated hinge having a non removable pin. Parts of a small magnet are attached to the stand and leg to keep the leg in place during transport. Such stands may be provided in a variety of different types of wood, and may be about ¾ inch thick. Front surfaces may be decorated in color paint or stain in solids, sunburst, or custom styles, each being a, work of art.

We claim:

1. A guitar stand, comprising in combination:

a) a generally upright backer having a front side that is inclined rearwardly, b) structure supporting the backer, c) and a guitar body support or supports, carried by the backer or said structure to project outwardly relative to said front face, to seat the lower portion or portions of the guitar body, with the guitar and its fingerboard then inclined upwardly and rearwardly proximate said backer front side, d) the backer, or a major portion of the backer, having an outline shape substantially the same as that of the guitar body, to be supported.

2. The combination of claim 1 wherein said supports are spaced to seat lower left and right portions of the guitar body.

3. The combination of claim 2 including the guitar body cradled by the supports.

4. The combination of claim 3 wherein the guitar body projects downwardly at the space between the left and right supports.

5. The combination of claim 4 wherein the left and right supports comprise left and right pegs projecting at generally the same level.

6. The combination of claim 4 wherein the backer projects upwardly rearwardly of the guitar body and fingerboard.

7. The combination of claim 1 wherein said structure supporting the backer includes leg means projecting downwardly relative to the backer, whereby the guitar is cradled by the backer and said outwardly projecting supports.

8. The combination of claim 7 wherein said leg means have floor engaging parts or surfaces which are spaced apart to stably support the backer with a guitar body seated on said body support or supports.

9. The combination of claim 8 wherein said leg means include two legs projecting downwardly from left and right portions of the backer.

10. The combination of claim 9 wherein said leg means include a rear leg projecting downwardly from a rear portion of the backer.

11. A guitar stand, comprising in combination:

a) a generally upright backer having a front side that is inclined rearwardly, b) structure supporting the backer, c) and a guitar body support or supports, carried by the backer or said structure to project outwardly relative to said front face, to seat the lower portion or portions of the guitar body, with the guitar and its fingerboard then inclined upwardly and rearwardly proximate said backer front side the backer, or a major portion of the backer, having an outline shape substantially the same as that of the guitar body to be supported, d) said structure supporting the backer including leg means protecting downwardly relative to the backer, whereby the guitar is cradled by the backer and said outwardly projecting supports, e) said leg means having floor engaging parts or surfaces which are spaced apart to stably support the backer with a guitar body seated on said body support or supports, f) said leg means including two legs projecting downwardly from left and right portions of the backer, g) said leg means including a rear leg projecting downwardly from a rear portion of the backer, h) and wherein said rear leg is pivotally connected to the backer, to swing between collapsed position adjacent the backer, and extended position projecting away from the backer rear portion.

12. The combination of claim 11 including a holder carried by the backer to hold the rear leg in said collapsed position.

13. The combination of claim 11 including magnetic means to hold the rear leg in said collapsed position.

14. The combination of claim 1 wherein said backer front side has a display face, to be fully visible when a guitar is removed from supported relation by said backer and projecting supports.

15. A guitar stand, comprising in combination a) a guitar carrier and a three point guitar body support on the carrier, b) and a multi-point ground engaging support for the carrier, c) and wherein the carrier or a major portion of the carrier has an outline shape the same as that of the guitar body, to be supported.

16. The combination of claim 15 including a guitar body supported on the carrier, and gravitationally cradled at the following locations:

i) at left and right locations adjacent curved body edges, ii) and at the back of the guitar body.

17. The combination of claim 11 wherein the backer or a major portion of the backer, has an outline shape the same as that of the guitar body or a lower portion of the guitar body, to be supported.

18. The combination of claim 1 including said guitar supported by the backer so that the guitar body outline is superimposed on the backer outline.

* * * * *